US011198975B2

(12) United States Patent
Hu et al.

(10) Patent No.: US 11,198,975 B2
(45) Date of Patent: Dec. 14, 2021

(54) RAILWAY ROADBED DFORMATION DETECTION AND EARLY WARNING SYSTEM

(71) Applicant: EAST CHINA JIAOTONG UNIVERSITY, Nanchang (CN)

(72) Inventors: Jun Hu, Nanchang (CN); Boyi Luo, Nanchang (CN); Yunwei Zhang, Nanchang (CN); Binyuan Shi, Nanchang (CN); Chengcheng Guo, Nanchang (CN)

(73) Assignee: EAST CHINA JIAOTONG UNIVERSITY, Nanchang (CN)

( * ) Notice: Subject to any disclaimer, the term of this patent is extended or adjusted under 35 U.S.C. 154(b) by 0 days.

(21) Appl. No.: 17/351,182

(22) Filed: Jun. 17, 2021

(65) Prior Publication Data

US 2021/0317618 A1 Oct. 14, 2021

Related U.S. Application Data

(63) Continuation of application No. PCT/CN2020/129761, filed on Nov. 18, 2020.

(30) Foreign Application Priority Data

Jan. 30, 2020 (CN) ..... 202010077509.1

(51) Int. Cl.
*E01F 11/00* (2006.01)
*E01B 35/12* (2006.01)
*E01B 1/00* (2006.01)

(52) U.S. Cl.
CPC ..... *E01B 35/12* (2013.01); *E01B 1/004* (2013.01); *E01F 11/00* (2013.01)

(58) Field of Classification Search
CPC ..... E01B 35/12; E01F 11/00
See application file for complete search history.

(56) References Cited

U.S. PATENT DOCUMENTS 7,376,530 B2 * 5/2008 Bienvenu ..... E02D 1/00 702/127
2011/0313686 A1 * 12/2011 Saracho Rotaeche .. E01B 35/00 702/42

(Continued)

FOREIGN PATENT DOCUMENTS

CN 202433013 U 9/2012
CN 204098005 1/2015

(Continued)

OTHER PUBLICATIONS

Design of multi-point detection system for high-speed railway subgrade deformation, Jiang Zhijun, etc., Automation Instrumentation, vol. 35, Issue 11, pp. 52-55, 59, published Dec. 31, 2014.

*Primary Examiner* — Qutbuddin Ghulamali

(57) ABSTRACT

A system for detecting and pre-warning railway roadbed deformation includes: a control box and an optical fiber-pressure sensor group. The optical fiber-pressure sensor group is formed by disposing a plurality of optical fiber-pressure sensors into a cuboid shape, and is buried in the railway roadbed for detecting magnitude of roadbed deformation in each direction. The direction of the deformation can be acknowledged easily, allowing the staff to eliminate potential risks purposefully. A time series prediction algorithm is performed to forecast a trend of the roadbed deformation in each direction, such that the staff may purposefully overhaul and correct the tracks where the roadbed is deformed excessively. At the same time, the staff may overhaul the track before the magnitude of the roadbed deformation reaches a predetermined value. Potential safety (Continued)

hazards may be eliminated in advance, ensuring the safety for the operation of the railroad.

6 Claims, 6 Drawing Sheets

(56) References Cited

U.S. PATENT DOCUMENTS

| | | | | |
|---|---|---|---|---|
| 2012/0286056 | A1* | 11/2012 | Qi | E01B 19/003 238/85 |
| 2013/0193223 | A1* | 8/2013 | Mei | C22C 38/24 238/150 |

FOREIGN PATENT DOCUMENTS

| | | |
|---|---|---|
| CN | 208076296 | 11/2018 |
| CN | 109680573 | 4/2019 |
| KR | 20150137907 A | 12/2015 |

* cited by examiner

RAILWAY ROADBED DFORMATION DETECTION AND EARLY WARNING SYSTEM

CROSS REFERENCE TO RELATED APPLICATIONS

The present application is a continuation-application of International (PCT) Patent Application No. PCT/CN2020/129761 filed on Nov. 18, 2020, which claims the foreign priority to the Chinese patent application No. 202010077509.1 filed on Jan. 30, 2020 in China National Intellectual Property Administration, and the entire contents of which are hereby incorporated by reference in its entirety.

TECHNICAL FIELD

The present disclosure relates to the field of railway roadbed detection, and in particular to detection for railway roadbed deformation and an early warning system.

BACKGROUND

Railway roadbed is a structure that supports and transmits a gravity of a rail track and a dynamic action of a train. The railway roadbed is foundation of the track, and is an important structure to ensure the train to operate normally. The roadbed is a structure in earth and stone. In a variety of topographic environments, geological environments, hydrological environments and climate environments, the roadbed may sometimes suffer from various disasters, such as floods, mudslides, collapses, earthquakes, resulting in deformation of the roadbed in various directions. When the roadbed is deformed, the track may be deformed accordingly, such that the track made of steel may be fractured and deflected easily under a pressure of the train, resulting in potential risks while the train is running. Regardless of a ballast track or a non-ballast track, as long as the roadbed below a track bed is deformed, the track above the roadbed may be deformed, thus affecting safety of the train while running.

In the art, the deformation is detected manually, a precision instrument may be applied to measure the deformation of the roadbed, and the steel track may be adjusted. A height of the steel track, a track gauge, and the like, may be adjusted to an original position. The solution may only detect the roadbed that has been deformed already, but may not forecast the deformation of the roadbed. Therefore, a potential failure of the steel track may not be forecasted before the steel track being deformed along with the deformation of the roadbed. Further, manual inspection along the track may be performed intermittently. Deformation of the roadbed may not be monitored in real time. Detecting the roadbed deformation along the railway point by point may not monitor an interval between roadbed deformation points, and working intensity of staff may be increased. In addition, a settlement plate buried under the roadbed may detect information of settlement of the roadbed, but the deformation of the roadbed in other directions may not be detected. Therefore, such the solution may not detect the deformation of the roadbed in other directions, such that it may not be determined whether the steel track is deflected in a horizontal direction.

SUMMARY OF THE DISCLOSURE

According to the present disclosure, a system for detecting the railway roadbed deformation and a system for warning the railway roadbed deformation in advance are provided. A plurality of optical-fiber and pressure sensors may be disposed to form a cuboid monitoring network to monitor the deformation of the roadbed in all directions and to forecast a trend of the deformation of the roadbed in all directions. In this way, the staff may perform appropriate measures to eliminate any potential malfunction before magnitude of the deformation of the roadbed reaching a limit, ensuring the safety of the train while running.

In order to achieve the above purpose, the present disclosure provides a system for detecting and pre-warning railway roadbed deformation.

The system for detecting and pre-warning railway roadbed deformation includes a control box and an optical fiber-pressure sensor group. The control box is disposed on a road shoulder and connected to the optical fiber-pressure sensor group, for processing information collected by the optical fiber-pressure sensor group. The optical fiber-pressure sensor group is formed by disposing a plurality of optical fiber-pressure sensors into a cuboid shape, and is buried in the railway roadbed for detecting magnitude of roadbed deformation in each direction.

In the present disclosure, the optical fiber-pressure sensor group is formed by disposing a plurality of optical fiber-pressure sensors into a cuboid shape, and is able to detect the magnitude of roadbed deformation in an upward direction, a downward direction, a frontward direction, a backward direction, a leftward direction, and a rightward direction of the roadbed. The staff may acknowledge the direction of the roadbed deformation, and a reference basis is provided for the staff to overhaul the track.

The control box includes an aluminum box, a blower, a power voltage dropping and stabilizing module, a relay group, an analog data collector, a control circuit board, a BeiDou positioning module, a shutter, an indicator, a GPRS module, a humidity sensor, and a temperature sensor. Each of the plurality of optical fiber-pressure sensors is connected to the analog data collector and is configured to transmit collected data information to the analog data collector. The power voltage dropping and stabilizing module is configured to supply power for the plurality of optical fiber-pressure sensors, the analog data collector, and the control circuit board. The analog data collector is configured to communicate with the control circuit board through an RS485 communication mode. The analog data collector is configured to convert analog information sent from the humidity sensor, the temperature sensor, and the optical fiber-pressure sensor group into corresponding digital information, and is further configured to transmit the digital information to the control circuit board through an RS485 line. The control circuit board is configured to determine the magnitude of roadbed deformation and a direction of the roadbed deformation based on the information of the optical fiber-pressure sensor group. The BeiDou positioning module is configured to transmit location information of the roadbed deformation to the control circuit board, and the control circuit board is configured to control the GPRS module to transmit the magnitude of roadbed deformation, the direction of roadbed deformation, and the location information of the roadbed deformation to a PC of relevant railroad department for display. The indicator is disposed on an upper surface of the aluminum box and is configured to light up in response to the magnitude of roadbed deformation of a location reaching the preset magnitude value to remind staff that a track at the location needs to be corrected. The humidity sensor is configured to detect humidity information inside the aluminum box, the temperature sensor is configured to detect temperature information inside the aluminum box. The blower is disposed on a left side of the aluminum box, the shutter is disposed on a right side of the aluminum box. The control circuit board is configured to control a working state of the relay group to open the shutter and turn on the blower, in response to a temperature value and a humidity value detected by the temperature sensor and the humidity sensor being greater than the preset temperature value and the present humidity value respectively, to cool down and dehumidify the aluminum box. The control circuit board is further configured to control blower to blow hot air into the aluminum box and to shut the shutter in response to the temperature value and the humidity value detected by the temperature sensor and the humidity sensor being less than the preset temperature value and the preset humidity value respectively. The temperature inside the aluminum box may be adjusted to reach the optimal temperature, providing the optimal temperature and humidity environment for the power voltage dropping and stabilizing module, the relay group, the analog data collector, the control circuit board, the BeiDou positioning module, and the GPRS module.

In the present embodiment, a heating wire is disposed at a vent of the blower. When the aluminum box needs to be heated, the control circuit board is configured to turn on the relay group to further turn on the blower and the heating wire to work. The blower is configured to blow heat generated by the heating wire into the aluminum box to supply heat for the aluminum box to supply heat for the aluminum box.

In the present disclosure, the shutter is movable. A slide groove, a gear rod, a gearwheel, a stepping motor, and a steel rod are disposed on an inner wall of the aluminum box on a side of the shutter. The gear rod is embedded in the slide groove, the gear wheel is disposed on a rotation shaft of the stepping motor, the stepping motor is connected to a relay. The control circuit board is configured to control a working state of the relay to control the stepping motor to rotate forwardly or reversely to drive the gear wheel to rotate. The gear wheel is configured to transmit rotation to the gear rod. Each blade of the shutter is connected to the gear rod through the steel rod. The gear rod is configured to drive the steel rod to move to open or shut the shutter.

According to the present disclosure, a method for detecting and pre-warning the railway roadbed deformation includes following operations.

The system may be initialized first. The optical fiber-pressure sensor group may detect the magnitude of the deformation of the railway roadbed in various directions, and may transmit the collected information to the analog data collector. Collection of the roadbed deformation may be completed. The analog data collector may transmit the received information to the control circuit board through the RS485 line. The control circuit board may determine magnitude and the direction of deformation of the roadbed based on the information of the optical fiber-pressure sensor group. Further, control circuit board may control the GPRS module to transmit the magnitude the roadbed deformation, the direction of the deformation, and the location of the deformation to the PC of the relevant railroad department for display. A corresponding upper computer may be configured at the PC. The collected information may be displayed on the upper computer. A time series prediction algorithm may be written in the control circuit board 9 to forecast the magnitude of the deformation of roadbed in each direction. The algorithm may forecast at which time point the magnitude of the deformation of the roadbed at a certain location in each direction may exceed the preset magnitude value. When the optical fiber-pressure sensor in one direction detects that the magnitude of the roadbed deformation exceeds the preset magnitude value, the control circuit board may control the indicator to light up and may send early warning information and the location information of the deformation to the PC of the railroad department for display. Relevant staff may be reminded to go to the deformation site to overhaul and correct the track. After the staff overhauls and corrects the track, the staff may press reset information of the control circuit board 9 to update the preset magnitude value of magnitude of the roadbed deformation in various directions, and may wait arrival of next early warning information.

According to the present disclosure, a method for identifying the direction of roadbed deformation may include following operations.

The optical fiber-pressure sensor disposed on each of six faces, i.e, an upper face, a lower face, a front face, a rear face, a left face and a right face, of the cuboid optical fiber-pressure sensor group may be numbered. Information collected by the optical fiber-pressure sensors disposed on the upper face, the lower face, the front face, the rear face, the left face and the right face may be connected to 0 to 5 channels of the analog data collector and may be numbered as A1, A2, A3, A4, A5, and A6 respectively. The analog data may be placed right after the channel of the analog data collector. A value of each channel of the analog data collector may be converted into a frame of data and transmitted to the control circuit board through the RS485 communication mode. The control circuit board may parse the received data and determine the number of bits of the data to identify from which channel of the analog data collector 8 the information is collected. In this way, the control circuit board may identify the data collected by the optical fiber-pressure sensors disposed on the upper face, the lower face, the front face, the rear face, the left face and the right face of the optical fiber-pressure sensor group. The identification method may include following operations.

(1) Identifying Settlement of the Roadbed

When the roadbed is settling downwardly, the A1 is configured to detect the roadbed deformation first, and subsequently the A2 is configured to detect the roadbed deformation, pressure generated on the A1 and the A2 is obvious, and magnitude of a signal change in the A1 and the A2 is large.

(2) Identifying Protrusion of the Roadbed Upwardly

When the roadbed protrudes upwardly, the A2 is configured to detect the roadbed deformation first, and subsequently, the A1 is configured to detect the upward protrusion of the roadbed, and the magnitude of the deformation detected by the A1 and the A2 is large.

(3) Identifying Leftward Protrusion

When the roadbed is deformed towards the left, the A5 is configured to detect the deformation first, and subsequently, the A6 is configured to detect the deformation, to determine the deformation of the roadbed is the leftward protrusion.

(4) Identifying Rightward Protrusion

When the roadbed protrudes towards a right relative to a vertical direction, the A6 is configured to detect the deformation first, and subsequently, the A5 is configured to detect the deformation, to determine the deformation of the roadbed is the rightward protrusion.

(5) Identifying an Inward Recess of the Roadbed

The inward recess refers to two sides of the roadbed being extruded inwardly relative to the vertical direction, and the roadbed has extruded deformation, the inward recess is less likely to occur, and changes in the A3 and the A4 are obvious.

(6) Identifying Outward Protrusion of the Roadbed

The outward protrusion comprises two-sided protrusion and single-sided protrusion, the two-sided protrusion refers to the roadbed protruding outwardly towards two sides relative to the vertical direction, the single-sided protrusion refers to the roadbed protruding outwardly towards one side relative to the vertical direction, and changes in the A3 and the A4 are obvious.

As the plurality of optical-fiber and pressure sensors are disposed to form the cuboid monitoring network to monitor the deformation of the roadbed in all directions, following technical effects may be achieved.

1. In the present disclosure, a cuboid optical fiber and pressure sensor group may be configured to monitor the deformation of the railroad roadbed in all directions. The direction in which the roadbed is deformed may be determined clearly, such that the staff may eliminate any hidden malfunction particularly.

2. In the present disclosure, a time series prediction algorithm may be performed to forecast the trend of the roadbed deformation in each direction, such that the staff may specifically overhaul and correct the tracks where the roadbed is deformed excessively. At the same time, the staff may overhaul the track before magnitude of the roadbed deformation reaches a predetermined value. Therefore, potential safety hazards may be eliminated in advance, ensuring the safety for the operation of the railroad.

REFERENCE NUMERALS FOR MAJOR ELEMENTS

| | | | |
|---|---|---|---|
| Control box | 1 | Optical fiber-pressure sensor group | 2 |
| Optical fiber-pressure sensor | 3 | Aluminum box | 4 |
| Blower | 5 | Power voltage dropping and stabilizing module | 6 |
| Relay group | 7 | Analog data collector | 8 |
| control circuit board | 9 | Bei Dou positioning module | 10 |
| Shutter | 11 | Indicator | 12 |
| GPRS module | 13 | Humidity- sensor | 14 |
| Temperature sensor | 15 | Heating wire | 16 |
| Slide groove | 17 | Gear rod | 18 |
| Gear wheel | 19 | Stepping motor | 20 |
| Steel rod | 21 | | |

DETAILED DESCRIPTION

The present disclosure will be illustrated in detail by referring to accompanying drawings and embodiments.

As shown in FIGS. 1 to 13, a system for detecting and pre-warning roadbed deformation is provided. The system may include a control box 1 and an optical fiber-pressure sensor group 2.

Figure 1:
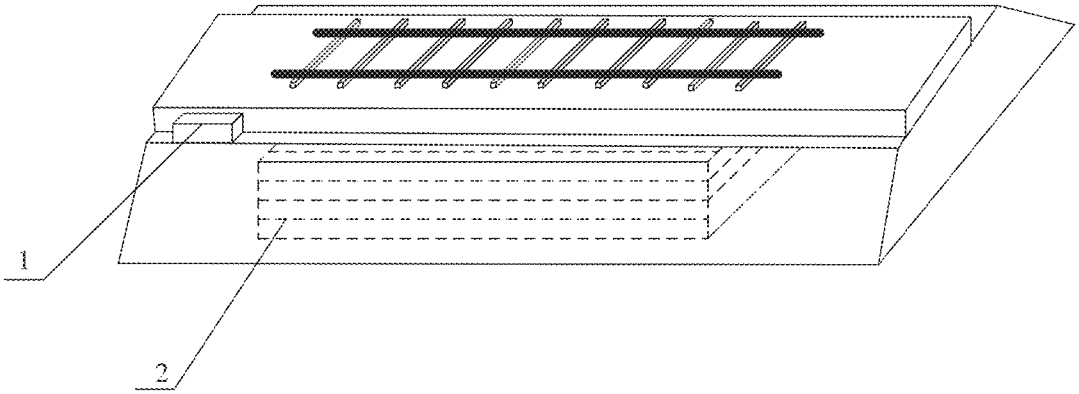
FIG. 1 is a schematic view of configuration of a system for detecting and pre-warning roadbed deformation according to an embodiment of the present disclosure.

As shown in FIG. 1, the control box 1 may be configured on a road shoulder and connected to the optical fiber-pressure sensor group 2 for processing information collected by the optical fiber-pressure sensor group 2. A plurality of optical fiber-pressure sensors 3 may be disposed to form a cuboid optical fiber-pressure sensor group 2. The optical fiber-pressure sensor group 2 may be buried into the railway roadbed for detecting the deformation of the roadbed in various directions. As the optical fiber may be resistant to interference caused by electromagnetic and atomic radiation; may have mechanical properties of having a fine diameter, being soft and having a smaller weight; may have electrical properties of being insulated and non-inductive; and may have chemical properties of being resistant to water, being resistant to high temperature, resistant to corrosion, and the like. The optical fiber may serve as human eyes and ears in areas that are out of reach to people or harmful to people. Further, the optical fiber may function beyond human physiological capabilities to receive external information that cannot be sensed by human. Therefore, burying the optical fiber-pressure sensors 3 in the railway roadbed may reliably detect the deformation of the roadbed.

Figure 2:
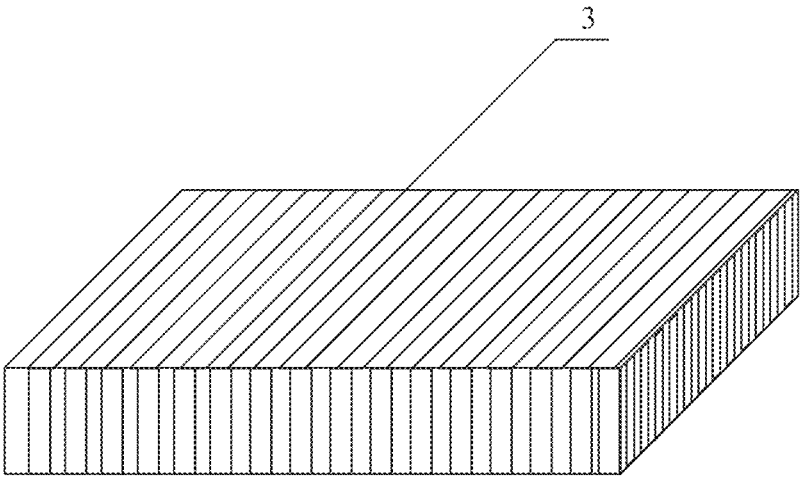
FIG. 2 is a structural schematic view of an optical fiber-pressure sensor of a system for detecting and pre-warning roadbed deformation according to an embodiment of the present disclosure.

As shown FIG. 2, the cuboid optical fiber-pressure sensor group 2, which is formed by the plurality of optical fiber-pressure sensors 3, may detect the deformation of the railway roadbed in eight directions: an upward direction, a downward direction, a frontward direction, a backward direction, a leftward direction and a rightward direction, such that the staff may know the direction of deformation of the roadbed easily, and a reference basis may be provided for the staff to overhaul the track. A cuboid shape of the optical fiber-pressure sensor group 2 is formed by burying the optical fiber-pressure sensor 3 in a section of the roadbed that is prone to be deformed.

Figure 3:
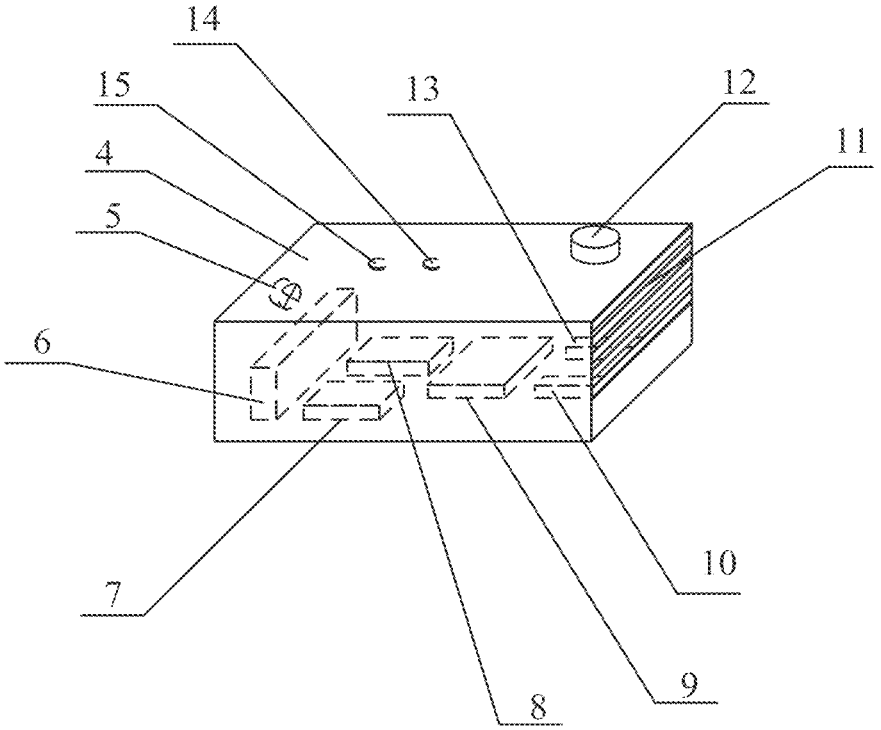
FIG. 3 is a structural schematic view of a control box of a system for detecting and pre-warning roadbed deformation according to an embodiment of the present disclosure.

As shown in FIG. 3, the control box 1 may include an aluminum box 4, a blower 5, a power voltage dropping and stabilizing module 6, a relay group 7, an analog data collector 8, a control circuit board 9, a BeiDou positioning module 10, a shutter 11, an indicator 12, a GPRS module 13, a humidity sensor 14, and a temperature sensor 15. Each optical fiber-pressure sensor in the optical fiber-pressure sensor group 2 may be connected to the analog data collector 8 and transmit collected data information to the analog data collector 8. The power voltage dropping and stabilizing module 6 may be connected to the optical fiber-pressure sensor 3, the analog data collector 8, and the control circuit board 9 respectively to provide power for the optical fiber-pressure sensor 3, the analog data collector 8, and the control circuit board 9. The control circuit board 9 may be connected to the analog data collector 8, the relay group 7, the BeiDou positioning module 10, the indicator 12, and the GPRS module 13. The analog data collector 8 and the control circuit board 9 may communicate through the RS485 communication mode. The analog data collector 8 may convert analog information, which is sent from the humidity sensor 14, the temperature sensor 15, and the optical fiber-pressure sensor group 2, into digital information, and transmit the digital information to the control circuit board 9 via an RS485 line. The control circuit board 9 may determine magnitude of the deformation of the roadbed and the direction of the deformation based on the information from the optical fiber-pressure sensor group 2. The BeiDou positioning module 10 may transmit a location of the deformation to the control circuit board 9. The control circuit board 9 may control the GPRS module 13 to transmit the magnitude of the deformation, the direction of the deformation, and the location of the deformation to a PC of relevant department for display. The indicator 12 may be disposed on an upper surface of the aluminum box. When the magnitude of the deformation of the railway roadbed at a location reaches a preset magnitude value, the control circuit board 9 may control the indicator 12 to light up a red light. When the magnitude of the deformation of the railway roadbed at a location does not reach the preset magnitude value, the control circuit board 9 may control the indicator 12 to light up a green light. In this way, the staff is reminded that the track at the location needs to be corrected. The temperature sensor 15 may be configured to detect temperature information in the aluminum box, and the humidity sensor 14 may be configured to detect humidity information in the aluminum box. The blower 5 may be disposed on a left side of the aluminum box. The shutter 11 may be disposed on a right side of the aluminum box. When the temperature sensor 15 and the humidity sensor 14 detect that a temperature value and a humidity value inside the aluminum box is greater than a preset temperature value and a preset humidity value respectively, the control circuit board 9 may control a working state of relay group 7 to open the shutter 11 and turn on the blower 5 to cool down the aluminum box and dehumidify the aluminum box. When the temperature inside the aluminum box is less than the preset temperature value, the blower 5 may blow hot air into the aluminum box and shut off the shutter 11, such that the temperature inside the aluminum box 4 may be adjusted to reach an optimal temperature, providing a most suitable temperature and humidity environment for the power voltage dropping and stabilizing module 6, the relay group 7, the analog data collector 8, the control circuit board 9, the Beidou positioning module 10, and the GPRS module 13, such that the components may operate normally and stably.

Figure 4:
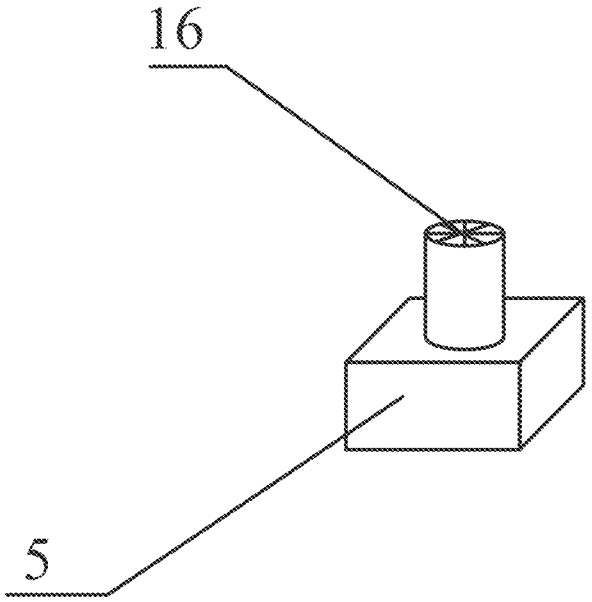
FIG. 4 is a schematic view of configuration of a blower and a heating wire of a system for detecting and pre-warning roadbed deformation according to an embodiment of the present disclosure.

As shown in FIG. 4, a heating wire 16 may be disposed at a vent of the blower 5. When the aluminum box needs to be heated, the control circuit board 9 may turn on the relay group 7, such that the blower 5 and heating wire 16 may be turned on and work. The blower 5 may blow heat generated by the heating wire 16 into the aluminum box, supplying heat for the aluminum box. When the aluminum box needs to be cooled or dehumidified, the control circuit board 9 may control the heating wire 16 to not work, control the shutter 11 to open, and control the blower 5 to blow external air into the aluminum box. In this way, exchange between the air inside and outside the aluminum box may be accelerated, such that cooling and dehumidification may be achieved.

Figure 5:
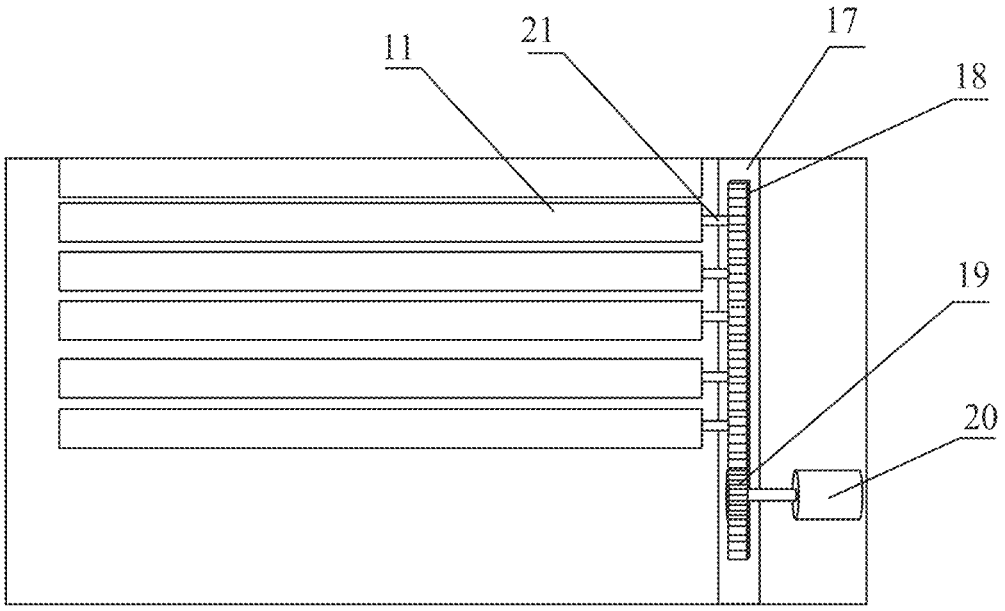
FIG. 5 is a schematic view of configuration of a shutter of a system for detecting and pre-warning roadbed deformation according to an embodiment of the present disclosure.

As shown in FIG. 5, the shutter 11 may be movable. A slide groove 17, a gear rod 18, a gear wheel 19, a stepping motor 20, and a steel rod 21 may be disposed on an inner wall of the aluminum box on a side of the shutter 11. The gear rod 18 may be embedded in the slide groove 17. The gear wheel 19 may be disposed on a rotation shaft of the stepping motor 20. The stepping motor 20 may be connected to the relay. The control circuit board 9 may control the working state of the relay to control the stepping motor 20 to rotate forwardly or reversely to further drive the gear wheel 19 to rotate. The gear wheel 19 may transmit rotation to the gear rod 18. Transmission between the gear wheel 19 and the gear rod 18 may be achieved by gear wheel-gear rod transmission. Each blade of the shutter 11 may be connected to the gear rod 18 through the steel rod 21. The gear rod 18 may drive the steel rod 21 to move to open or shut the shutter 11. Configuring the shutter 11 to be movable may facilitate adjustment of the temperature and humidity environment inside the aluminum box, such that the control box 1 may work in a more suitable temperature and humidity environment and may have an extended service life.

The control circuit board 9 may take the STM32F103ZET6 microcontroller as a kernel. The STM32F103ZET6 microcontroller may have a fast processing speed and a plurality of peripheral interfaces, and may identify the magnitude of the deformation collected from various directions by the optical fiber-pressure sensor group 2.

Figure 6:
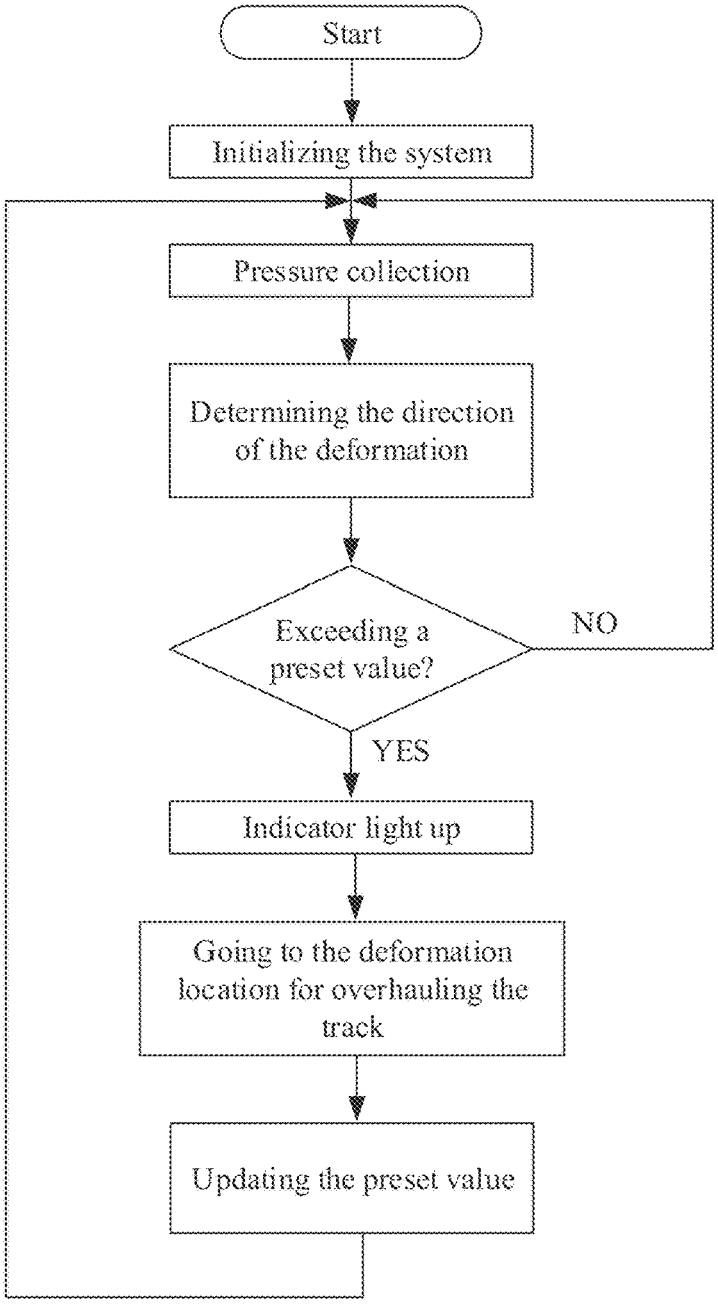
FIG. 6 is a flow chart of a method for detecting and pre-warning roadbed deformation according to an embodiment of the present disclosure.

As shown in FIG. 6, the method for detecting and prewarning the deformation of the railway roadbed may include following operations.

The system may be initialized first. The optical fiber-pressure sensor group 2 may detect the magnitude of the deformation of the railway roadbed in various directions, and may transmit the collected information to the analog data collector 8. Collection of the roadbed deformation may be completed. The analog data collector 8 may transmit the received information to the control circuit board 9 through the RS485 line. The control circuit board 9 may determine magnitude and the direction of deformation of the roadbed based on the information of the optical fiber-pressure sensor group 2. Further, control circuit board 9 may control the GPRS module 13 to transmit the magnitude the roadbed deformation, the direction of the deformation, and the location of the deformation to the PC of the relevant railroad department for display. A corresponding upper computer may be configured at the PC. The collected information may be displayed on the upper computer. A time series prediction algorithm may be written in the control circuit board 9 to forecast the magnitude of the deformation of roadbed in each direction. The algorithm may forecast at which time point the magnitude of the deformation of the roadbed at a certain location in each direction may exceed the preset magnitude value. When the optical fiber-pressure sensor 3 in one direction detects that the magnitude of the roadbed deformation exceeds the preset magnitude value, the control circuit board 9 may control the indicator 12 to light up and may send early warning information and the location information of the deformation to the PC of the railroad department for display. Relevant staff may be reminded to go to the deformation site to overhaul and correct the track. After the staff overhauls and corrects the track, the staff may press reset information of the control circuit board 9 to update the preset magnitude value of magnitude of the roadbed deformation in various directions, and may wait arrival of next early warning information. In this way, the staff may purposefully repair and correct the track where the roadbed is deformed excessively. At the same time, the staff may overhaul the track before the magnitude of the deformation of the roadbed reaches the preset magnitude value. Safety hazards may be eliminated in advance, the safe operation of the railroad may be guaranteed.

In the present disclosure, a method for the optical fiber-pressure sensor group 2 to identify the direction of the roadbed deformation may include following operations.

The optical fiber-pressure sensor 3 disposed on each of six faces, i.e, an upper face, a lower face, a front face, a rear face, a left face and a right face, of the cuboid optical fiber-pressure sensor group 2 may be numbered. Information collected by the optical fiber-pressure sensors 3 disposed on the upper face, the lower face, the front face, the rear face, the left face and the right face may be connected to 0 to 5 channels of the analog data collector 8 and may be numbered as A1, A2, A3, A4, A5, and A6 respectively. The analog data may be placed right after the channel of the analog data collector 8. A value of each channel of the analog data collector 8 may be converted into a frame of data and transmitted to the control circuit board 9 through the RS485 communication mode. The control circuit board 9 may parse the received data and determine the number of bits of the data to identify from which channel of the analog data collector 8 the information is collected. In this way, the control circuit board 9 may identify the data collected by the optical fiber-pressure sensors 3 disposed on the upper face, the lower face, the front face, the rear face, the left face and the right face of the optical fiber-pressure sensor group 2. A method for identification may include following operations.

(1) Identification of Settlement

Figure 7:
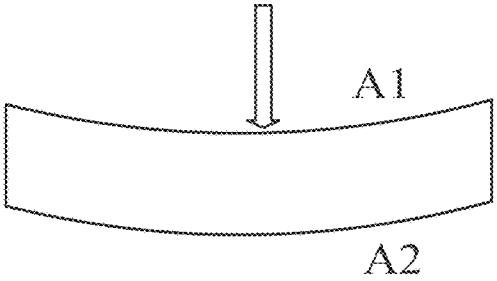
FIG. 7 is a schematic view of roadbed of a system for detecting and pre-warning roadbed deformation being settled according to an embodiment of the present disclosure.

As shown in FIG. 7, the roadbed may be extruded by the train for a long period of time, soil density under the roadbed may increase, such that the roadbed may settle downwardly. While the roadbed is settling downwardly, the A1 may detect the roadbed deformation first, and subsequently, the A2 may detect the roadbed deformation. Pressure generated on the A1 and the A2 may be relatively obvious, and magnitude of a signal change in the A1 and the A2 may be relatively larger.

(2) Identification of Protrusion Upwardly

Figure 8:
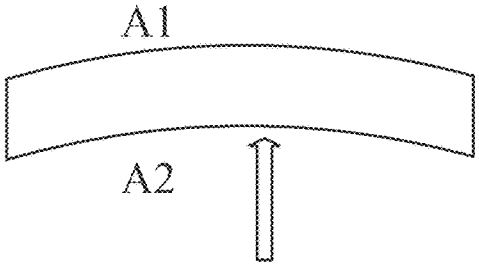
FIG. 8 is a schematic view of roadbed of a system for detecting and pre-warning roadbed deformation being protruded upwardly according to an embodiment of the present disclosure.

As shown in FIG. 8, crustal changes may cause some sections of a road to be squeezed upwardly, which may lead to deformation of the roadbed. That is, the roadbed may protrude upwardly. The A2 may detect the deformation of the roadbed first, and subsequently, the A1 may detect the upward protrusion of the roadbed. The magnitude of the deformation detected by the A1 and the A2 may be relatively large.

(3) Identification of Leftward Protrusion

Figure 9:
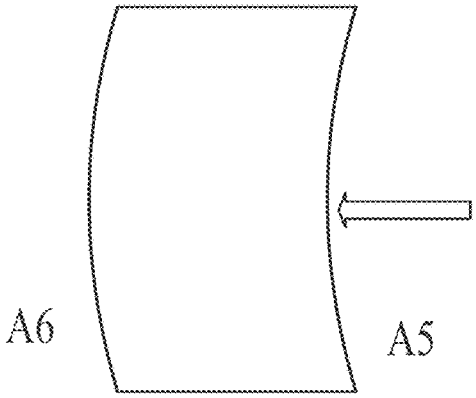
FIG. 9 is a schematic view of roadbed of a system for detecting and pre-warning roadbed deformation being protruded towards a left according to an embodiment of the present disclosure.

As shown in FIG. 9, the roadbed may be extruded towards a left relative to a vertical direction, such that the roadbed is deformed towards the left. The A5 may detect the deformation first, and subsequently, the A6 may detect the deformation. In this way, the deformation of the roadbed may be determined as the leftward protrusion.

(4) Identification of Rightward Protrusion

Figure 10:
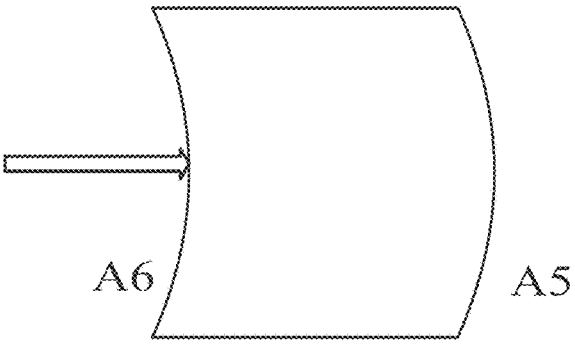
FIG. 10 is a schematic view of roadbed of a system for detecting and pre-warning roadbed deformation being protruded towards a right according to an embodiment of the present disclosure.

As shown in FIG. 10, the roadbed may be extruded towards a right relative to the vertical direction, such that the roadbed is deformed towards the right. The A6 may detect the deformation first, and subsequently, the A5 may detect the deformation. In this way, the deformation of the roadbed may be determined as the rightward protrusion.

(5) Identification of an Inward Recess

Figure 11:
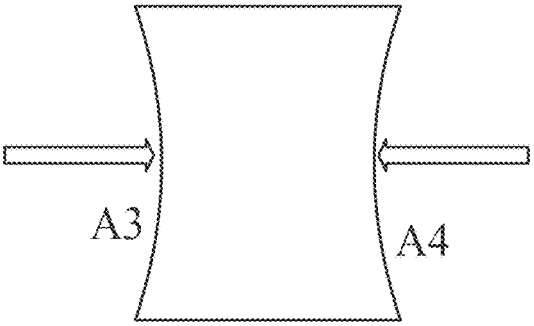
FIG. 11 is a schematic view of roadbed of a system for detecting and pre-warning roadbed deformation being recessed inwardly according to an embodiment of the present disclosure.

As shown in FIG. 11, the inward recess may refer to two sides of the roadbed being extruded inwardly relative to the vertical direction, such that the roadbed has extruded deformation. This situation may be less likely to occur, changes in the A3 and the A4 may be relatively obvious.

(6) Identification of an Outward Protrusion

Figure 12:
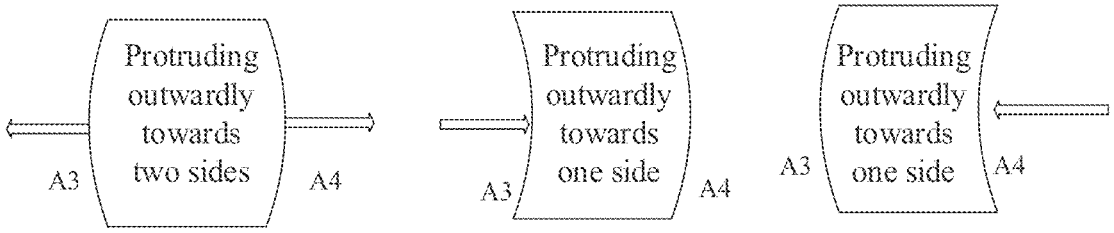
FIG. 12 is a schematic view of roadbed of a system for detecting and pre-warning roadbed deformation being protruded outwardly according to an embodiment of the present disclosure.

As shown in FIG. 12, the outward protrusion may include into a two-sided protrusion and a single-sided protrusion. The two-sided protrusion may refer to the roadbed protruding outwardly towards two sides relative to the vertical direction. The single-sided protrusion may refer to the roadbed protruding outwardly towards one side relative to the vertical direction. A severe outward protrusion may be represented as a slope of the roadbed being damaged, which may affect stability of the roadbed, and changes in the A3 and the A4 may be relatively obvious.

A working principle of the present disclosure may be illustrated hereinafter.

Figure 13:
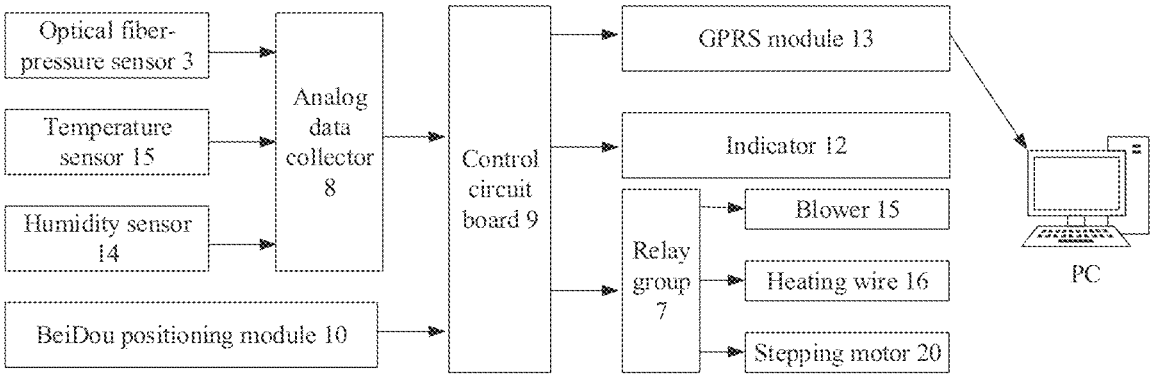
FIG. 13 is diagram showing a working principle of a system for detecting and pre-warning roadbed deformation according to an embodiment of the present disclosure.

As shown in FIG. 13, the humidity sensor 14, the temperature sensor 15, and each optical fiber-pressure sensor in the optical fiber-pressure sensor group 2 may transmit collected data information to the analog data collector 8. The analog data collector 8 may convert the analog information sent by the humidity sensor 14, the temperature sensor 15, and the optical fiber-pressure sensor group 2 into corresponding digital information, and may transmit the digital information to the control circuit board 9 through the RS485 line. The control circuit board 9 may determine the magnitude and the direction of the roadbed deformation based on the information sent from the optical fiber-pressure sensor group 2. The BeiDou positioning module 10 may transmit the location information of the deformation to control circuit board 9. The control circuit board 9 may control the GPRS module 13 to send the magnitude of the deformation, the direction of the deformation, forecast information, and the location of the deformation to the PC of the railroad department for display. When the optical fiber-pressure sensor 3 for one direction detects that the magnitude of the roadbed deformation in the direction exceeds the preset value, the control circuit board 9 may control the indicator 12 to light up, and may send the early warning information and the location information to the PC of the railroad department for display, reminding the relevant staff to go to the deformation site to overhaul and correct the track. After the staff overhauls and corrects the track, the staff may press the reset information of the control circuit board 9 to update the threshold value of the magnitude of the deformation in each direction, and may wait arrival of the next warning message. When the temperature sensor 15 and the humidity sensor 14 detect the temperature value and the humidity value inside the aluminum box is greater than the preset value, the control circuit board 9 may control the working state of relay group 7 and the working state of the stepping motor 20. The shutter 11 may open, and the blower 5 may be turned on, to cool and dehumidify the aluminum box. When the temperature inside the aluminum box is less than the preset value, the control circuit board 9 may control the working state of the relay group 7 to further control the heating wire 16 to heat and control the blower 5 to operate. The heat generated by the heating wire 16 may be blown into the aluminum box. The control circuit board 9 may control the stepping motor 20 to rotate to shut the shutter 11, such that the temperature inside the aluminum box 4 may be adjusted to reach the optimum temperature, providing a proper temperature and humidity environment for the power voltage dropping and stabilizing module 6, the relay group 7, the analog data collector 8, the control circuit board 9, the BeiDou positioning module 10, and the GPRS module 13.

What is claimed is:

1. A system for detecting and pre-warning railway roadbed deformation, comprising: a control box and an optical fiber-pressure sensor group, wherein the control box is disposed on a road shoulder and connected to the optical fiber-pressure sensor group, for processing information collected by the optical fiber-pressure sensor group;

the optical fiber-pressure sensor group is formed by disposing a plurality of optical fiber-pressure sensors into a cuboid shape, and is buried in the railway roadbed for detecting magnitude of roadbed deformation in each direction;

the optical fiber-pressure sensor group comprises the plurality of optical fiber-pressure sensors and is configured to detect the magnitude of roadbed deformation in an upward direction, a downward direction, a frontward direction, a backward direction, a leftward direction, and a rightward direction of the roadbed;

the control box comprises an aluminum box, a blower, a power voltage dropping and stabilizing module, a relay group, an analog data collector, a control circuit board, a BeiDou positioning module, a shutter, an indicator, a general packet radio service (GPRS) module, a humidity sensor, and a temperature sensor;

each of the plurality of optical fiber-pressure sensors is connected to the analog data collector and is configured to transmit collected data information to the analog data collector;

the power voltage dropping and stabilizing module is configured to supply power for the plurality of optical fiber-pressure sensors, the analog data collector, and the control circuit board;

the analog data collector is configured to communicate with the control circuit board through an RS485 communication mode;

the analog data collector is further configured to convert analog information sent from the humidity sensor, the temperature sensor, and the optical fiber-pressure sensor group into corresponding digital information, and is further configured to transmit the digital information to the control circuit board through an RS485 line;

the control circuit board is configured to determine the magnitude of roadbed deformation and a direction of the roadbed deformation based on the information of the optical fiber-pressure sensor group;

the BeiDou positioning module is configured to transmit location information of the roadbed deformation to the control circuit board, and the control circuit board is configured to control the GPRS module to transmit the magnitude of roadbed deformation, the direction of roadbed deformation, and the location information of the roadbed deformation to a PC for display;

the indicator is disposed on an upper surface of the aluminum box and is configured to light up in response to the magnitude of roadbed deformation of a location reaching a preset magnitude value to remind staff that a track at the location needs to be corrected;

the humidity sensor is configured to detect humidity information inside the aluminum box, the temperature sensor is configured to detect temperature information inside the aluminum box;

the blower is disposed on a left side of the aluminum box, the shutter is disposed on a right side of the aluminum box;

the control circuit board is configured to control a working state of the relay group to open the shutter and turn on the blower, in response to a temperature value and a humidity value detected by the temperature sensor and the humidity sensor being greater than a preset temperature value and a preset humidity value respectively, to cool down and dehumidify the aluminum box;

the control circuit board is further configured to control blower to blow hot air into the aluminum box and to shut the shutter in response to the temperature value and the humidity value detected by the temperature sensor and the humidity sensor being less than the preset temperature value and the preset humidity value respectively.

2. The system according to claim 1, wherein a slide groove, a gear rod, a gear wheel, a stepping motor, and a steel rod are disposed on an inner wall of the aluminum box on a side of the shutter;

the gear rod is embedded in the slide groove, the gear wheel is disposed on a rotation shaft of the stepping motor, the stepping motor is connected to a relay;

the control circuit board is configured to control a working state of the relay to control the stepping motor to rotate forwardly or reversely to drive the gear wheel to rotate;

the gear wheel is configured to transmit rotation to the gear rod;

each blade of the shutter is connected to the gear rod through the steel rod; and the gear rod is configured to drive the steel rod to move to open or shut the shutter.

3. The system according to claim 1, wherein a heating wire is disposed at a vent of the blower;

when the aluminum box needs to be heated, the control circuit board is configured to turn on the relay group to further turn on the blower and the heating wire to work;

the blower is configured to blow heat generated by the heating wire into the aluminum box to supply heat for the aluminum box;

when the aluminum box needs to be cooled down or dehumidified, the control circuit board is configured to control the heating wire to not work, open the shutter, and control the blower to blow external air into the aluminum box.

4. The system according to claim 1, wherein the system is configured to perform a method for detecting and pre-warning the railway roadbed deformation, and the method comprises operations of:

initializing the system;

detecting, by the optical fiber-pressure sensor group, the magnitude of roadbed deformation in each direction, and transmitting collected information to the analog data collector to complete collection of the roadbed deformation;

transmitting, by the analog data collector, the information to the control circuit board through an RS485 line;

determining, by the control circuit board, the magnitude and the direction of roadbed deformation based on the information of the optical fiber-pressure sensor group, and controlling the GPRS module to transmit the magnitude of roadbed deformation, the direction of roadbed deformation, and the location of roadbed deformation to the PC for display, wherein a computer is configured at the PC, and displaying the collected information on the computer;

writing a time series prediction algorithm in the control circuit board to forecast the magnitude of roadbed deformation in each direction;

forecasting, by the algorithm, at which time point the magnitude of roadbed deformation at the location in any direction may exceed the preset magnitude value;

controlling, by the control circuit board, the indicator to light up, and sending early warning information and the location of the deformation to the PC for display to remind the staff to go to the location of the deformation to overhaul and correct the track, in response to any one of the plurality of optical fiber-pressure sensors in one direction detecting that the magnitude of roadbed deformation exceeds the preset magnitude value;

pressing reset information of the control circuit board to update the preset magnitude value of the magnitude of roadbed deformation in each direction after the track being overhauled and corrected; and waiting arrival of next early warning information.

5. The system according to claim 4, wherein the optical fiber-pressure sensor disposed on an upper face of the cuboid optical fiber-pressure sensor group, the optical fiber-pressure sensor disposed on a lower face of the cuboid optical fiber-pressure sensor group, the optical fiber-pressure sensor disposed on a front face of the cuboid optical fiber-pressure sensor group, the optical fiber-pressure sensor disposed on a rear face of the cuboid optical fiber-pressure sensor group, the optical fiber-pressure sensor disposed on a left face of the cuboid optical fiber-pressure sensor group and the optical fiber-pressure sensor disposed on a right face of the cuboid optical fiber-pressure sensor group are numbered;

information collected by the optical fiber-pressure sensors 3 disposed on the upper face, the lower face, the front face, the rear face, the left face and the right face is connected to 0 to 5 channels of the analog data collector and numbered as A1, A2, A3, A4, A5, and A6 respectively;

the analog data is placed right after each of the 0 to 5 channels of the analog data collector;

a value of each of the 0 to 5 channels of the analog data collector is converted into a frame of data and transmitted to the control circuit board through the RS485 communication mode;

the control circuit board is configured to parse the received frame of data and determine the number of bits of the data to identify from which channel of the analog data collector the information is collected to identify the data collected by the optical fiber-pressure sensors disposed on the upper face, the lower face, the front face, the rear face, the left face and the right face of the optical fiber-pressure sensor group.

6. The system according to claim 5, wherein identifying the data collected by the optical fiber-pressure sensors disposed on the upper face, the lower face, the front face, the rear face, the left face and the right face of the optical fiber-pressure sensor group comprises:

(1) identifying settlement of the roadbed, wherein when the roadbed is settling downwardly, the A1 is configured to detect the roadbed deformation first, and subsequently the A2 is configured to detect the roadbed deformation, pressure generated on the A1 and the A2 is obvious, and magnitude of a signal change in the A1 and the A2 is large;

(2) identifying protrusion of the roadbed upwardly, wherein when the roadbed protrudes upwardly, the A2 is configured to detect the roadbed deformation first, and subsequently, the A1 is configured to detect the upward protrusion of the roadbed, and the magnitude of the deformation detected by the A1 and the A2 is large;

(3) identifying leftward protrusion, wherein when the roadbed is deformed towards the left, the A5 is configured to detect the deformation first, and subsequently, the A6 is configured to detect the deformation, to determine the deformation of the roadbed is the leftward protrusion;

(4) identifying rightward protrusion, wherein when the roadbed protrudes towards a right relative to a vertical direction, the A6 is configured to detect the deformation first, and subsequently, the A5 is configured to detect the deformation, to determine the deformation of the roadbed is the rightward protrusion;

(5) identifying an inward recess of the roadbed, wherein the inward recess refers to two sides of the roadbed being extruded inwardly relative to the vertical direction, and the roadbed has extruded deformation, the inward recess is less likely to occur, and changes in the A3 and the A4 are obvious; and (6) identifying outward protrusion of the roadbed, wherein the outward protrusion comprises two-sided protrusion and single-sided protrusion, the two-sided protrusion refers to the roadbed protruding outwardly towards two sides relative to the vertical direction, the single-sided protrusion refers to the roadbed protruding outwardly towards one side relative to the vertical direction, and changes in the A3 and the A4 are obvious.

* * * * *